United States Patent [19]

Selwood, deceased et al.

[11] 4,115,041

[45] Sep. 19, 1978

[54] PUMPS

[75] Inventors: Peter Richard Selwood, deceased, late of Southampton, England; by Timothy John Selwood, executor, Minstead, Near Cadnam, England; by Martin John Shelley Axtell, executor, Lymington, England; John David Burton, St. Mary Bourne, Near Andover, England

[73] Assignee: William R. Selwood Limited, Eastleigh, England

[21] Appl. No.: 676,882

[22] Filed: Apr. 14, 1976

[30] Foreign Application Priority Data

Apr. 15, 1975 [GB] United Kingdom ..... 15366/75

[51] Int. Cl.[2] ..... F04B 23/10; F04B 43/08

[52] U.S. Cl. ..... 417/440; 417/523

[58] Field of Search ..... 417/244, 254, 413, 541, 417/259, 523

[56] References Cited

U.S. PATENT DOCUMENTS

| | | | |
|---|---|---|---|
| 1,211,680 | 1/1917 | Constantinesco | 417/241 |
| 2,634,684 | 4/1953 | Alvarez et al. | 417/413 |
| 2,936,041 | 5/1960 | Sharp et al. | 417/540 |
| 2,951,450 | 9/1960 | Fisher | 417/542 |
| 3,172,369 | 3/1965 | Ballu | 417/540 |
| 3,307,492 | 3/1967 | Selwood | 417/244 |
| 3,685,923 | 8/1972 | Hutchins et al. | 417/523 |

*Primary Examiner*—William L. Freeh
*Attorney, Agent, or Firm*—Spencer & Kaye

[57] ABSTRACT

A pump comprising a body having at least one chamber and preferably two axially spaced and aligned pumping chambers, each such pumping chamber communicating at opposite ends respectively with a pump inlet and a pump outlet and containing an actuator reciprocable longitudinally of the pumping chamber by drive means, the actuator having a rigid main central portion and a peripherally extending elastic sealing ring in non-sliding fluid-tight engagement with a lateral wall of the pumping chamber and having mounted thereon actuator valve means controlling the flow of fluid from the inlet to the outlet of the pump, the pumping chambers communicating at their outlet ends with manifold passageways in the body of the pump which in turn communicate with respective passageways in an outlet duct situated on opposite sides of a longitudinally extending web therein terminating at a position spaced from the downstream end of the outlet duct to provide for cyclic flow of the pump fluid out of one pumping chamber and into the other around the downstream end of said web when shut off occurs at the pump outlet, fluid inductance means and fluid capacitance means with the latter operative throughout the pumping cycle being provided to limit the internal pressure to a safe value under shut off conditions.

11 Claims, 14 Drawing Figures

113a
181b
182
181a
183b
183a
113
167
162b
180
166
162c
168
162a
162
165
165a
114
165b
114a
170
170a 182
14
113
113a
181a
162
167
166
168
165
114
170
4
170a 178
175
176
171
177
174
173
172

PUMPS

BACKGROUND OF THE INVENTION

1. Field of the Invention

This invention relates to pumps (hereinafter referred to as being of the kind specified) each such pump comprising a body having at least one pumping chamber communicating at opposite ends and respectively with a pump inlet and a pump outlet, an actuator in the pumping chamber reciprocable longitudinally thereof by drive means and having a relatively rigid main central portion and a peripherally extending sealing ring retained in a clearance space and in non-sliding fluid-tight engagement between the central portion and a lateral wall of the pumping chamber, valve means controlling the flow of fluid through the pumping chamber from the inlet to the outlet, and fluid inductance means and fluid capacitance means operative between the pump inlet and outlet for controlling the operational characteristic of the pump.

2. Description of the Prior Art

A pump of the kind specified was disclosed and claimed in our prior U.S. Pat. No. 3,307,492. The practical embodiments disclosed were intended for use in pumping water, possibly with suspended solids, for drainage purposes of the sites of building or civil engineering work and for such applications and others to which such pumps were intended to be applied the outlet of the pump would be permanently open. To assist priming, the valve means provided included not only a one-way valve mounted on the actuator itself (the actuator valve means) but also further one-way valves situated in the flow path of the liquid through the pump for permitting only flow in a direction from the inlet to the outlet of the pump and situated upstream and downstream of the actuator. In particular the one-way valve provided downstream of the actuator was positioned between the actuator and the fluid capacitance (referred to in our prior patent aforesaid as a pressure absorbing and restoring means).

Whilst the configurations, i.e. the general arrangement of actuator valve means and fluid capacitance and inductance (the last mentioned being referred to in our prior patent aforesaid as a slug duct section), are eminently suitable for pumps such as those intended to be used as aforesaid at civil engineering or building sites or elsewhere in cases where a permanently open pump outlet is called for or is acceptable, they are not suitable for certain other applications.

In particular, in many forms of fluid handling plant in which a pump is required to be installed, the delivery of fluid from the outlet of the pump may be controlled by a stop valve situated at or downstream of the pump outlet and which, when closed manually or otherwise, prevents or severely restricts the delivery of the fluid. Similar or analogous conditions of operation may arise in other circumstances.

In such circumstances the practical embodiments of the pump disclosed in our aforementioned prior patent would give rise to the problem that there would be an excessive rise of pressure in the pumping chamber downstream of the actuator and damage to the pump could occur in consequence of this either by exceeding the stress limit for the pumping chamber itself or for components of the drive means or actuator. It would not be possible for the excessive pressure rise to be relieved or reduced by flow of fluid internally of the pump between one and another of a plurality of pumping chambers because communication between the chambers would, under conditions of shut-down, be blocked or disabled by the one-way valves situated at the outlet of the pumping chambers. Further, the fluid capacitance means, if contained in, or partly in, the chambers, would not be effectively or fully effective to relieve the adverse conditions.

Further, the conventional solution of providing a separate relief valve would entail quite severe economic penalties since relief valves which perform reliably and satisfactorily under a wide variety of conditions of operation involve high manufacturing costs, possibly approaching those of the pump itself.

SUMMARY OF THE INVENTION

The present invention is based upon the concept derived from careful analysis of the flow and pressure characteristics of a pump of the kind specified that the latter can be constructed in a form to provide for avoidance of the development of excessive pressure under conditions of closure at the pump outlet without unacceptably diminishing the beneficial characteristics within the normal working range of the pump, e.g. volumetric efficiency (dimensionless flow) greater than unity. Further, the present invention is additionally based upon analysis of the pressure and flow characteristics of the pumps of the kind specified indicating that a further benefit achieved by the construction accommodating the shut-off condition without excessive pressure rise will also entail a limiting of power consumed in driving the pump as the pressure is increased towards flow shut-off.

According to the present invention we provide a pump of the kind specified incorporating the improvement wherein said valve means controlling flow of fluid through said pumping chamber is mounted exclusively on said actuator, said body defines a flow path from said inlet to said outlet of a configuration to afford flow in a pressure relief mode internally of said body cyclically from and to said pumping chamber when delivery from said outlet is shut off, said fluid capacitance comprises fluid capacitance means operative throughout the pumping cycle.

Preferably the pump includes a plurality of pumping chambers and respectively associated actuators and drive means therefor to operate the actuators at uniformly spaced phases throughout the pumping cycle, and the pressure relief portion of the flow path includes ducts connecting each such chamber to the outlet and/or inlet, each such duct forming part of the fluid inductance.

The fluid capacitance may in some cases be formed wholly by one or more elastically deformable or displaceable components situated in the pumping chamber itself or forming a boundary of the pumping chamber or the fluid inductance adjacent to the boundary of the pumping chamber. Components which are suitable to provide the required fluid capacitance are the sealing ring of the actuator and/or the actuator valve and an elasticaly deformable or displaceable wall component, adjacent to the outlet of the pumping chamber, of a delivery duct comprising the fluid inductance.

BRIEF DESCRIPTION OF THE DRAWINGS

The invention will now be described, by way of example, with reference to the accompanying drawings wherein.

DESCRIPTION OF THE PREFERRED EMBODIMENTS

Figure 1:
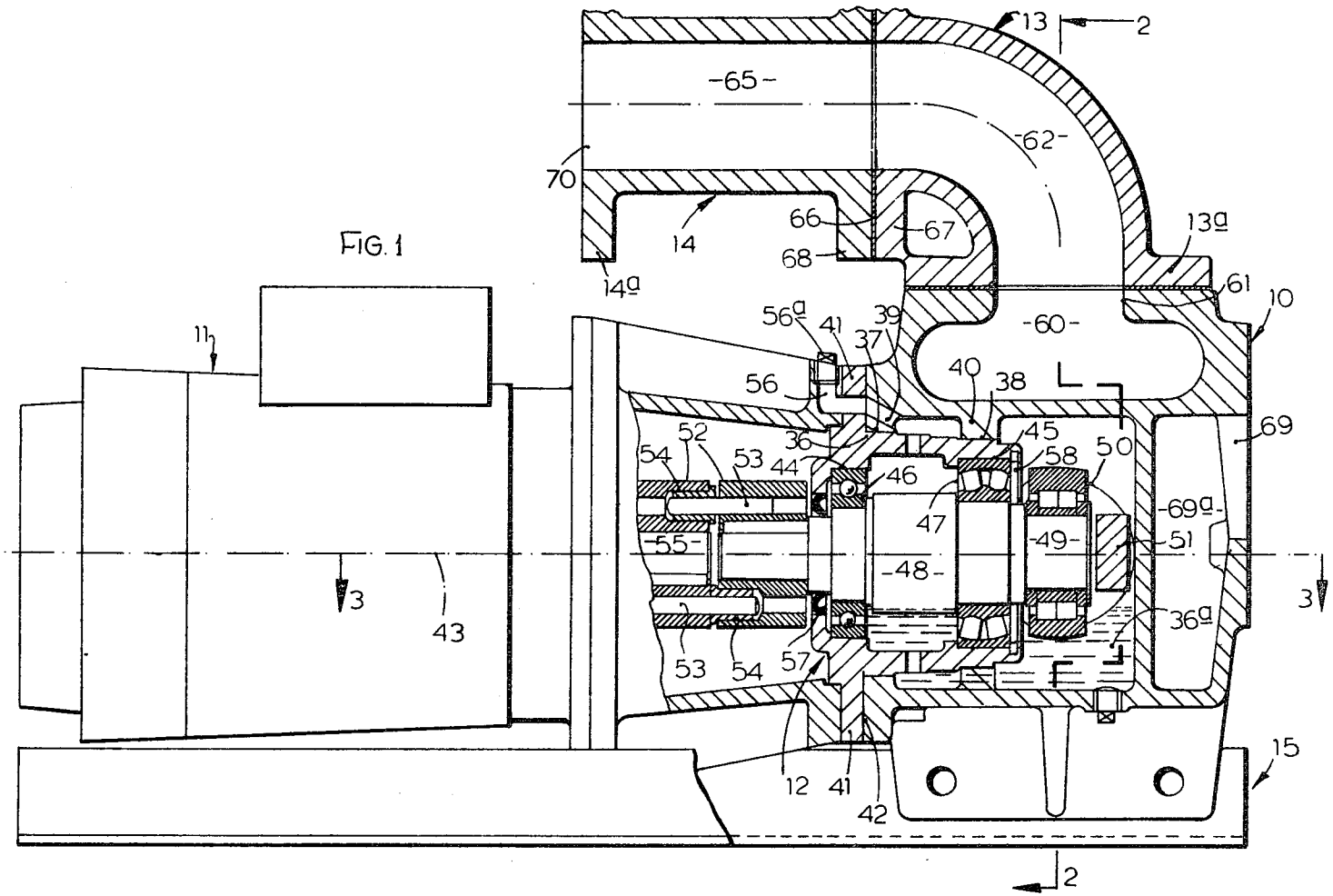
FIG. 1 is a view in side elevation and partly in vertical cross-section through one embodiment of pump in accordance with the invention.

The pump illustrated comprises the following units, namely a main pumping chamber and delivery manifold unit 10, a drive motor 11, a drive unit 12 serving to transmit drive from the motor 11 to a connecting rod and thence to the actuators of the main unit 10, fluid delivery units 13 and 14 forming parts of a fluid inductance means of the pump, and a supporting base 15. The term "pump body" is to be deemed to include the units 10, 13 and 14.

Referring specifically to the main pumping chamber and manifold unit 10, this incorporates two cylindrical portions 16*a*, 16*b* forming the side walls of respective pumping chambers 17*a*, 17*b* and integrally connected with each other by a central cylindrical portion 18 forming the lateral boundary of a chamber 19 between the two pumping chambers.

Within the two pumping chambers are mounting sleeves 20*a* and 20*b* integrally connected by frusto-conical webs 21*a* and 21*b* to the side walls of the pumping chambers at the inner ends of the latter.

The pumping chambers contain actuators 23*a*, 23*b* movable axially of the pumping chambers and comprising rigid main central portions 24*a*, 24*b* and peripherally extending sealing rings 25*a*, 25*b* which have attachment portions seated in annular recesses in the peripheral faces of the main central portions and in the side walls of the pumping chamber so as to establish a non-sliding but fluid-tight relationship. The sealing rings are of radial dimensions to ensure that they are maintained in radial compression in the clearance space between the main central portion of each actuator and the side wall of the associated pumping chamber throughout the stroke of the actuator.

The actuators are coupled to each other by a connecting rod 26 having end portions 26*a*, 26*b* received in sockets afforded by the main central portions of respective actuators. The end portions 26*a* 26*b* are sealed with respect to the pumping chambers concerned by sealing rings 28*a*, 28*b* which are also under radial compression and have inner attachment portions compressed between shoulders 29*a*, 29*b* on the connecting rod and the opposing end faces of bosses 30*a*, 30*b* while outer attachment portions of these sealing rings are received in recesses in the supporting sleeves 20*a*, 20*b*.

Associated with each actuator is an actuator valve comprising apertures 31*a*, 31*b* extending axially through the main central portion, annular valve seatings 32*a*, 32*b* on the downstream face of each actuator, and flap valve elements 33*a*, 33*b* overlying these apertures and engaging the valve seatings, the flap valve elements being retained by mounting bushes 34*a*, 34*b* screwing onto threaded end portions of pins 35*a*, 35*b* integral with the end portions 26*a*, 26*b*. The flap valve elements of the actuator valve may be bonded to these bushes.

Referring now to the drive means, the driving motor 11 may be either an electric motor or an internal combustion engine. In the former case the electric motor will ordinarily be an alternating current induction motor adapted to run at a predetermined speed, for example 1500 r.p.m. when energised from a 50 cycle A.C. supply, and in the latter case the internal combustion engine would normally be equipped with some form of governing device so that it operates within a predetermined speed range.

The drive unit (FIGS. 1 and 3) comprises a generally cylindrical housing 36 located radially by seatings 37 and 38 on its outer face against complementary seatings afforded at the inner peripheries of locating flanges 39, 40 on the main unit 10 and located axially by abutment of a radially projecting flange 41 against a facing 42 on the main unit 10 on the flange 39. Suitable pin or dowel means (not shown) may be provided to complete the location of the drive unit angularly about axis 43.

The housing 36 has internal seatings 44 and 45 for the outer races of bearings 46, 47.

Supported by these bearings is a drive spindle 48 terminating at its inner end in an integral eccentric element or crank pin 49 carrying the inner race of a further bearing 50, the outer race of which is engaged with the mid portion or yoke 51 of the connecting rod 26 so as to effect reciprocation thereof axially of the pumping chambers for driving the actuators associated therewith.

At its opposite end the spindle 48 is provided with one of a pair of complementary coupling elements 52 releasably engaged axially with each other through the intermediary of dowel pins 53 and sockets 54, the other of these elements being fixed on the motor shaft 55.

The chamber containing the bearings 46, 47 may contain oil 36*a*, filler duct 56 and closure plug 56*a* being provided for this purpose and a suitable oil seal being provided in association with the bearing 46 as indicated at 57. Bearing 47 is retained in its seating by circlip 58.

The outer ends of the pumping chambers are enclosed by cylinder heads 57*a*, 57*b* which at their upper sides afford passageways 58*a*, 58*b* communicating directly with manifold passageways 59*a*, 59*b* in the main unit 10, these latter passageways being separated from each other at their inner ends by a vertical web 60 projecting upwardly into an outlet 61.

Any suitable sealing means 61*a*, 61*b* are provided at the abutting edge faces between the cylinder heads 57*a*, 57*b* and the faces of the main unit 10 which these abut, the cylinder heads being held in fluid-tight relation by any suitable securing means such as bolts (not shown).

The delivery unit 13 which may be in the form of a flanged elbow-shaped duct is sub-divided internally by a diametral web 62 coplanar with the web 60 and a gasket 63 interposed between the flange 13*a* of the unit 13 and the facing 64 surrounding outlet 61 includes a strip element 63*a* establishing a fluid-tight seal between the webs 60 and 62.

If desired the delivery unit 14 may likewise be sub-divided internally be a web 65 and in this case the gasket 66 between the flanges 67 and 68 would likewise include a strip effecting a seal between the opposing edge faces of the webs 65 and 62. The flanges 13*a*, 67 and 68 are secured in the assembled relation shown by bolts (not shown).

It will be understood that the length of each delivery unit and the number of delivery units present may be varied as required for the purpose of varying the fluid inductance. Further, each such delivery unit may be subdivided internally by a web as aforesaid but where a reduced fluid inductance is required, and it is nevertheless physically convenient still to retain the former length of the delivery unit, the web may be omitted from an appropriate number of units starting from the downstream end, e.g. the web may be omitted from delivery unit 14 if desired.

In operation the fluid to be pumped enters at inlet 69 and passes from inlet chamber 69*a* in the main unit to the pumping chambers 17*a*, 17*b* at the inner sides of the actuators thereof, passes through the actuators by way of the actuator valves already described during certain parts of the pumping cycle, and is subjected to powered flow by the actuators and thence passes out through passageways 58*a*, 58*b* along ducts 59*a*, 59*b* and through delivery units 13 and 14 on opposite sides of the webs 60, 62, 65 to outlet 70.

By virtue of the columns of fluid existing and in motion in the pumping chambers 17*a*, 17*b* and inlet ducts thereto, the passageways 58*a*, 58*b* and passageways 59*a*, 59*b*, a certain intrinsic fluid inductance is present. Additionally, however, a further, designed, fluid inductance is provided by virtue of the fluid existing and in motion in the passageways 62*a*, 62*b* situated on opposite sides of the web 62, and 62*a*, 65*b* on opposite sides of web 65. Fluid capacitance means is also present in the form of elastically deformable components situated on the downstream sides of the actuators in the pumping chamber, namely sealing rings 25*a*, 25*b* and the actuator valve elements 33*a*, 33*b*.

Figure 2:
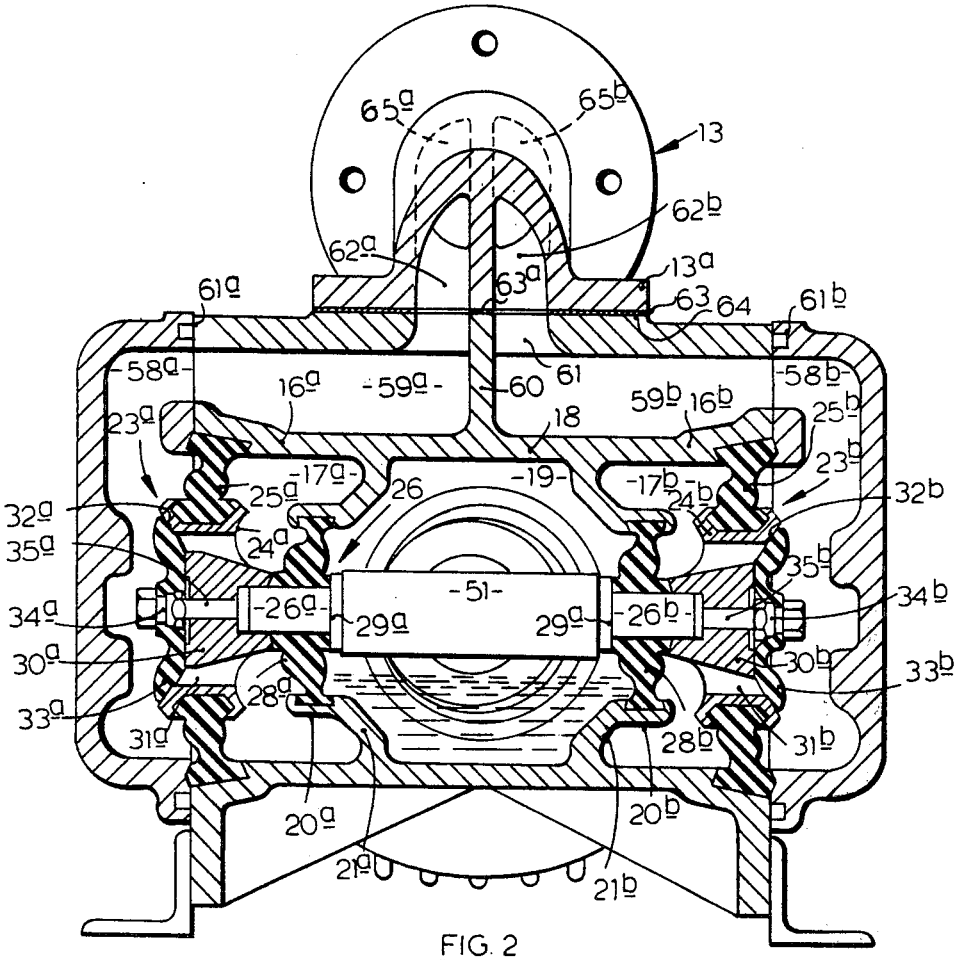
FIG. 2 is a view in transverse cross-section on the line 2—2 of FIG. 1.
Figure 3:
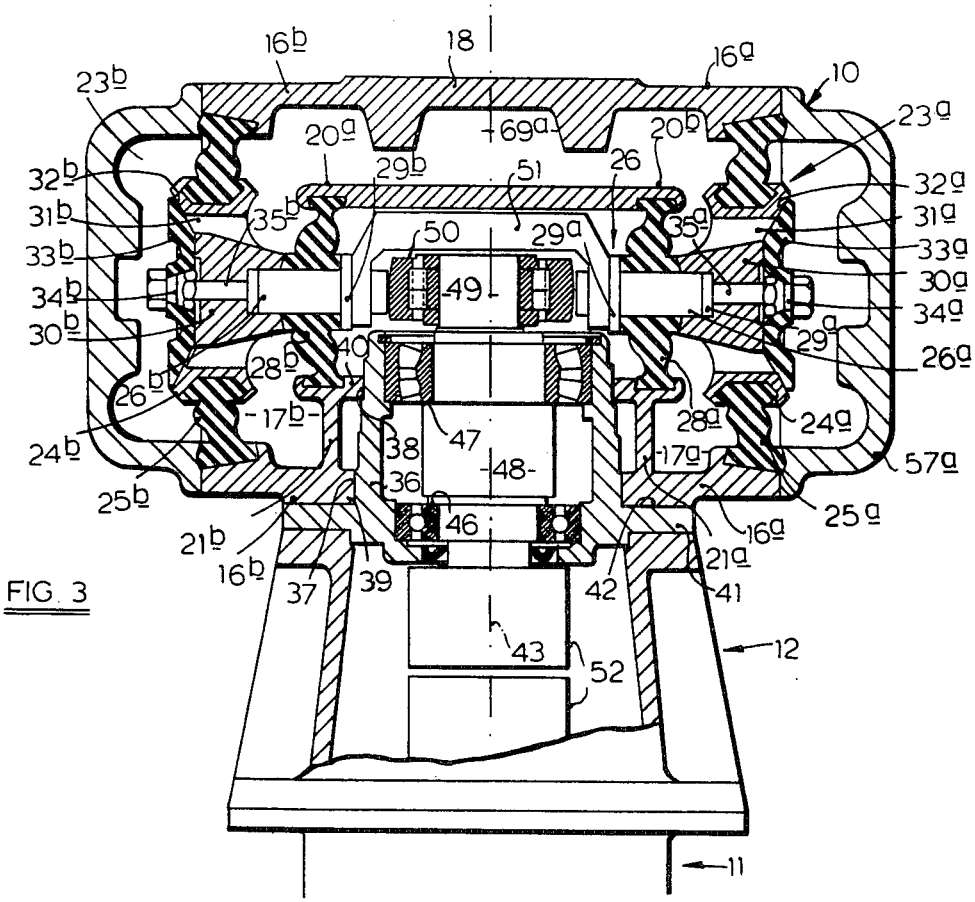
FIG. 3 is a plan view in cross-section on the line 3—3 of FIG. 1.
Figures 4, 5:
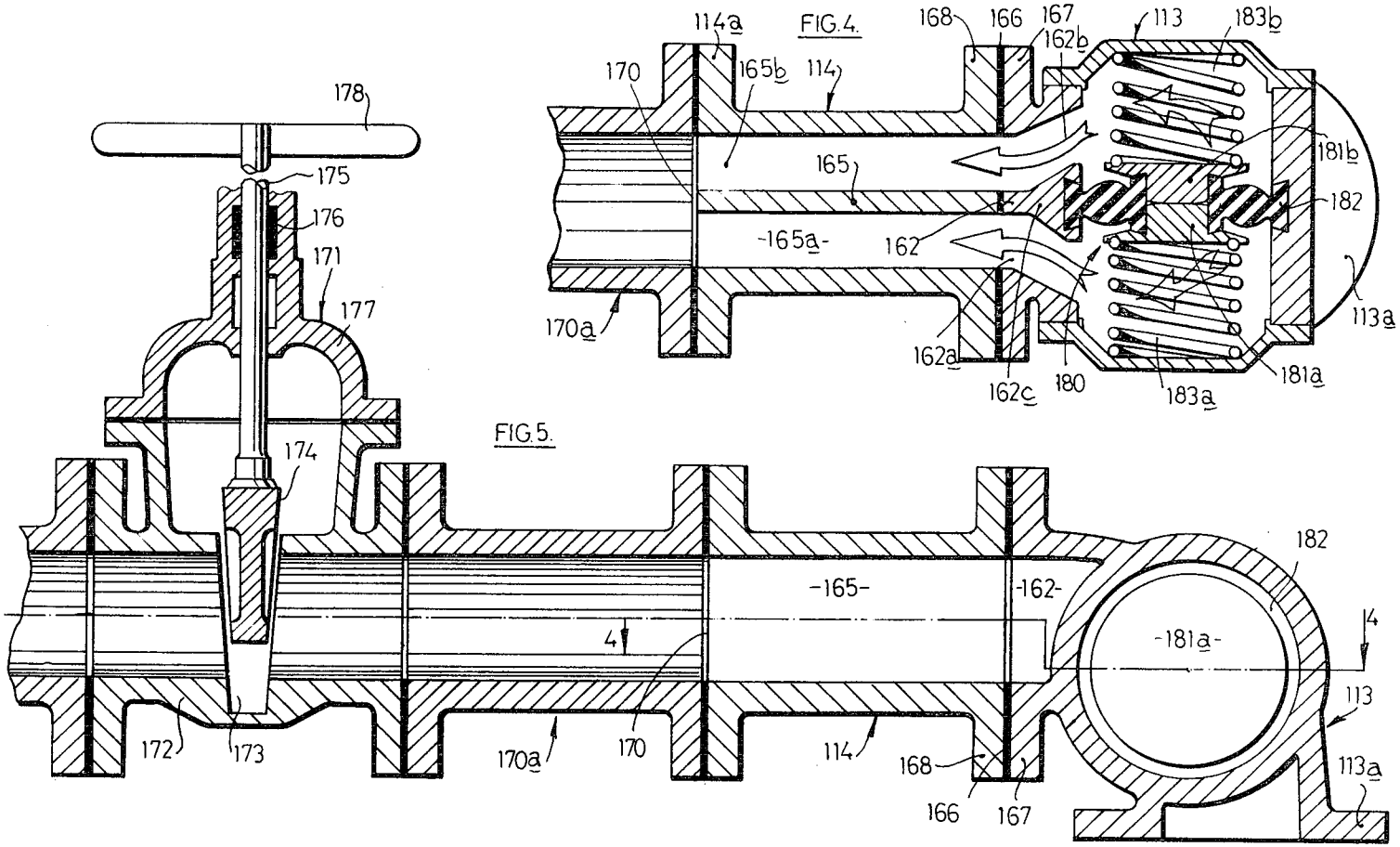
FIG. 4 is a fragmentary plan view in horizontal cross-section on the line 4—4 of FIG. 5 showing a form of capacitance means which may be employed alternatively or in addition to the capacitance means incorporated in the pump of FIGS. 1 to 3.
FIGS. 5 is a view in vertical cross-section through the delivery duct incorporating the capacitance means of FIG. 4 and containing a stop valve.

Alternatively, or in addition, fluid capacitance means may be provided in the form illustrated in FIGS. 4 and 5. In these Figures parts corresponding functionally to these included in the embodiment shown in FIGS. 1 to 3 are designated by like references with the prefix 100 and the preceding description is to be deemed to apply to these. The delivery unit 113 is formed with an aperture in its web 162 conveniently of circular form and containing a laterally displaceable assembly 180 which effectively forms part of the web 162 and hence the boundary between the passageways 162*a*, 162*b* situated on opposite sides of the web and which provide the fluid inductance.

The assembly 180 comprises a central part which may be formed of rigid material and which includes two components 181*a*, 181*b* collectively forming a disc having a radially outwardly presented channel in which is seated the inner periphery of a sealing ring 182, the outer periphery of which is seated in an undercut recess formed at the inner peripheral surface of the aperture and in an enlarged portion 162*c* of the web 162. The sealing ring 182 is preferably radially compressed between the enlarged portion 162*c* and the components 181*a*, 181*b* forming the centre disc, these latter being centered by coiled compression springs 183*a*, 183*b*. If desired the two components 181*a* and 181*b* may be secured together by one or more fastening elements.

It will be noted that the sealing ring 182 is a similar shape in cross-section to that forming the outer part of the actuator and that providing a seal between the end portions 126*a*, 126*b* of the connecting rod and the inner end of the pumping chamber concerned. Such sealing rings are, therefore, able to undergo deflection to accommodate lateral movements of the components 181*a*, 181*b* in response to difference of fluid pressure in the passageways 162*a*, 162*b*, energy being stored in one of the springs 183*a* and released from the other so that the fluid capacitance is being "charged" with respect to flow taking place in one of these passageways whilst being discharged with respect to flow taking place in the other.

The pump may be installed in a fluid handling system which incorporates a stop valve for shutting off the flow of fluid delivered from the pump or such stop valve may be provided as part of the pump assembly, as shown in FIG. 5. In either case the passageways at the downstream end of the web 65 or 165, and which form the downstream portions of the fluid inductance, are so arranged that communication between them exists both when the stop valve is open and when the stop valve is closed. Thus the web 65 or 165 may terminate inwardly of the delivery duct unit 14, i.e. to the right of the end face of connection flanges 14*a* or 114*a*, or alternatively, as shown in FIGS. 4 and 5, an additional delivery duct unit 170*a* following on outlet 170 and not sub-divided internally by a web may be interposed between the unit 14 or 114 and a stop valve 171. The latter may take any suitable form but typically comprises a duct section 172 having a slot 173, the axial boundaries of which form a valve seat and into which is movable a valve element 174 carried by an operating rod 175 extending through a gland in the stop valve casing 177 and having a handle 178 to enable it to be so moved.

Figure 6:
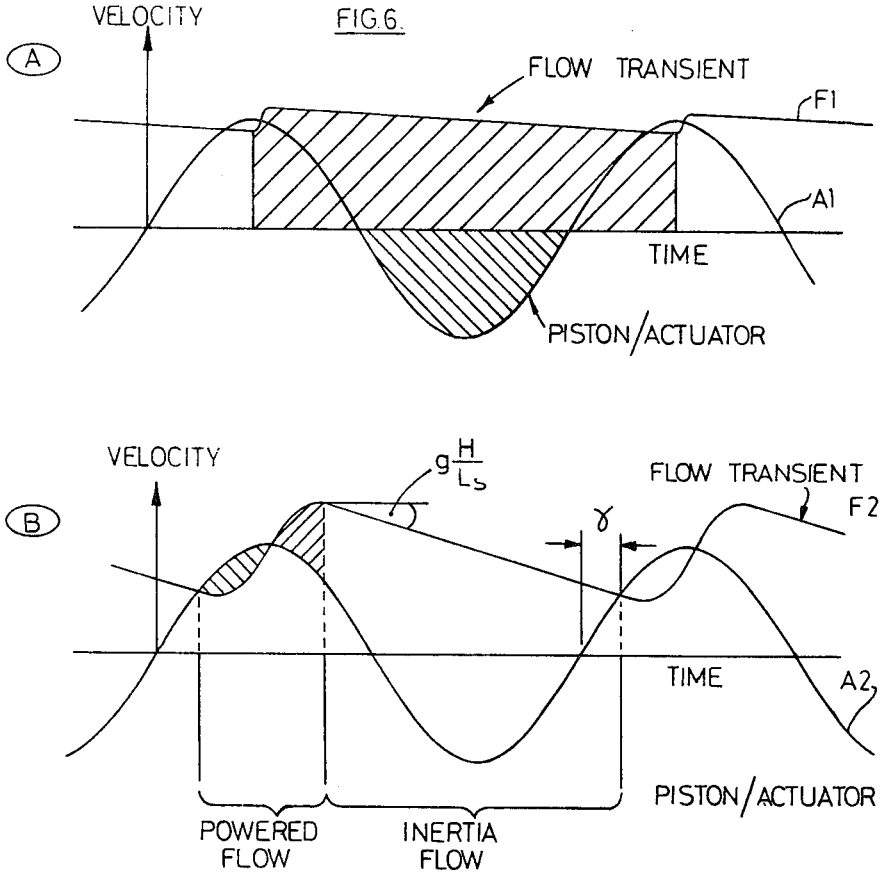
FIGS. 6A to 6D illustrate graphically and schematically the characteristics of fluid flow and actuator movement of the pump operating against low pressure heads.

FIGS. 6A and 6B for one pumping chamber and delivery passageway show actuator velocity (curves A1, A2) and typical transient fluid flow velocity (curves F1, F2) both plotted against time and generated within the pump when pumping respectively against zero and a low to moderate external head.

There is no reversal of flow in the inductance, and at the end of the powered flow the fluid retards at a rate $gH/Ls$, where Ls is the length of the inductance. In the case of zero head, the flow discharged from the pump per cylinder per cycle will be $Vp\ A\ 2\ \pi/\Omega$ (area under the flow transient in FIG. 6A) whilst the volume swept by the piston actuator will be $2\ Vp\ A/\Omega$ Thus the volumetric efficiency $\phi$ will be:

$$\phi = Vp\,A\,\frac{2\,\pi}{\Omega} \Big/ \frac{2\,Vp\,A}{\Omega} = \pi$$

In FIG. 6A the shaded area (rising hatching) above the axis represents volume of fluid discharged per stroke. The shaded area below the axis (falling hatching) represents volume swept by the piston per stroke.

It will be noted that in FIG. 6B, when pumping takes place against the head which is above zero but still of a low value, say 20% of the shut-off head, the proportion of the time occupied by powered flow relative to inertia flow has increased as has also the rate of retardation of inertia flow. The shaded area (rising hatching) represents fluid volume stored in the capacitance during powered flow, and the shaded area (falling hatching) is equal and represents fluid volume fed back out of the capacitance. Powered flow ends when these shaded areas are equal. Alternatively expressed powered flow ends when the flow transient is equal to $gH/Ls$.

Diagrammatic views 6C and 6D illustrate respectively by establishment of powered flow and inertia flow for the left-hand pumping chamber 17*a* as represented by the full line arrows F*p* and F*i*. The pumping chamber 17*b*, the powered flow F*p* and inertia flow F*i* is represented by the broken arrows, the direction of movement of the connecting rod and the two actuators being indicated by arrow S.

Figure 7:
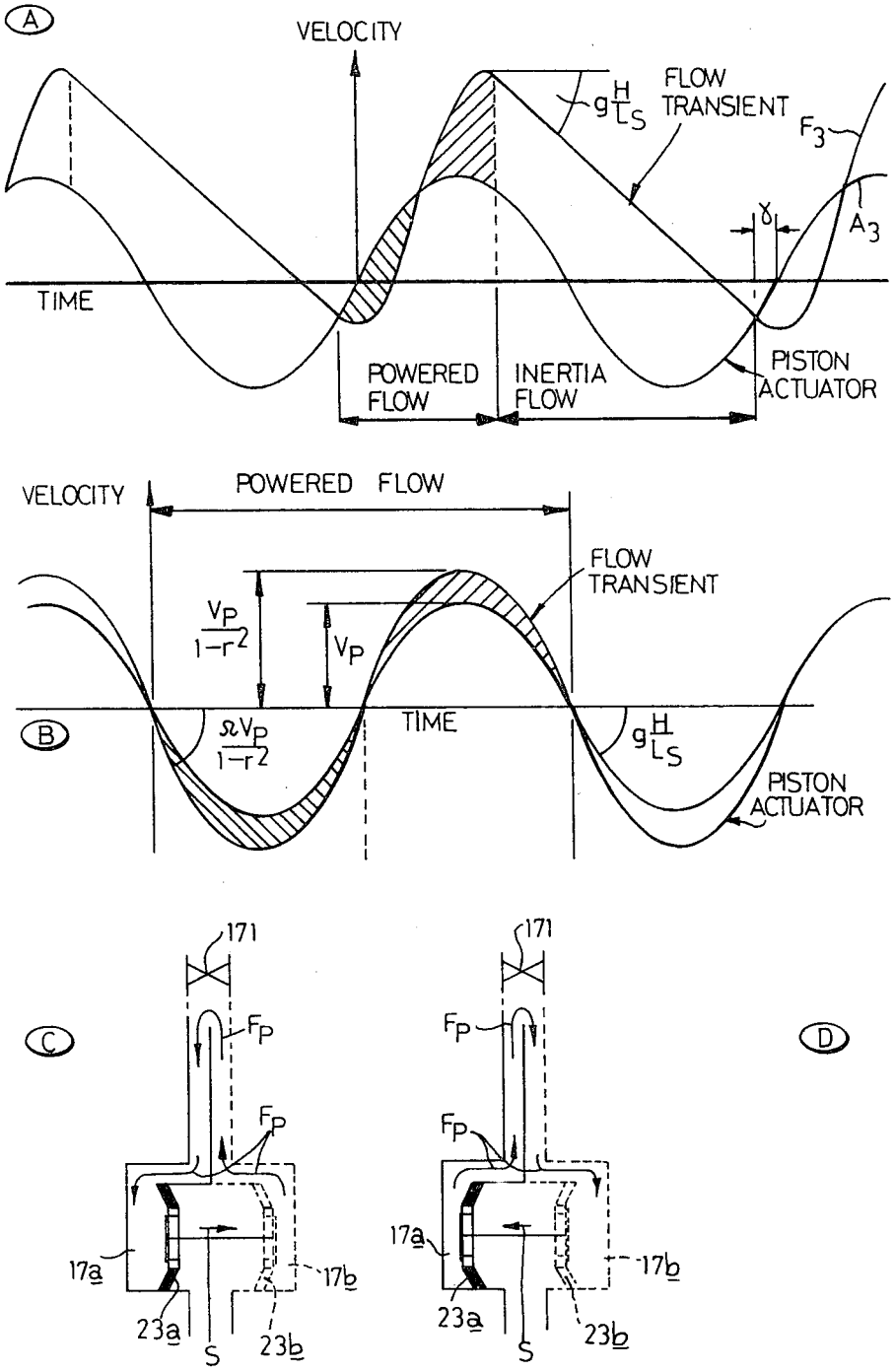
FIGS. 7A to 7D illustrate graphically and schematically the characteristics shown in FIG. 6 when the pump is operating against a high head and under flow stop conditions such as would be produced by closure of the valve shown in FIG. 5.

At medium heads, as shown in FIG. 7A in which curve A3 represents actuator velocity and curve F3 flow velocity again for one pumping chamber and associated delivery passageway (inductance), the powered flow occupies a greater proportion of the flow cycle and some flow reversal in the inductance occurs towards the end of the inertia flow part of the cycle.

At zero flow, maximum head, FIG. 7B, the powered flow occupies the whole of the flow cycle and the fluid in the inductance delivery passageway undergoes harmonic displacement with maximum velocity $(b/1 - \rho^2)$ times V*p* the maximum effective velocity of the piston actuator where $\rho$ is the ratio of excitation frequency to natural frequency of the L − C combination. The rate of retardation of the flow in the inductance at the end of the powered flow in FIG. 7B will be $gH(Q = 0)/Ls$ or in this case $$\frac{Vp}{1 - \Gamma^2}\,\Omega \text{ so that:}$$

$$H(Q = O) = Ls\left(\frac{Vp\,\Omega}{g}\right)\frac{1}{1 - \Gamma^2} = Ls\left(\frac{\Omega^2 R}{g}\right)\left(\frac{Ap}{A}\right)\frac{1}{1 - \Gamma^2}$$

where $H(Q = 0)$ is the maximum or shut-off head that may be generated by the pump. The shaded areas with rising and falling hatching in both FIGS. 7A and 7B correspond to conditions of operation as described for FIG. 6B.

Diagrammatic views 7C and 7D illustrate the path of flow of fluid through the pump under shut-off conditions and for opposite strokes of the connecting rod joining the actuators. It will be noted that flow takes place entirely along the internal flow path afforded by the pumping chambers and inductance sections of the delivery passageways as shown by the arrows Fp, there being zero inflow and zero outflow, the shut-off valve 171 being closed.

Figure 8:
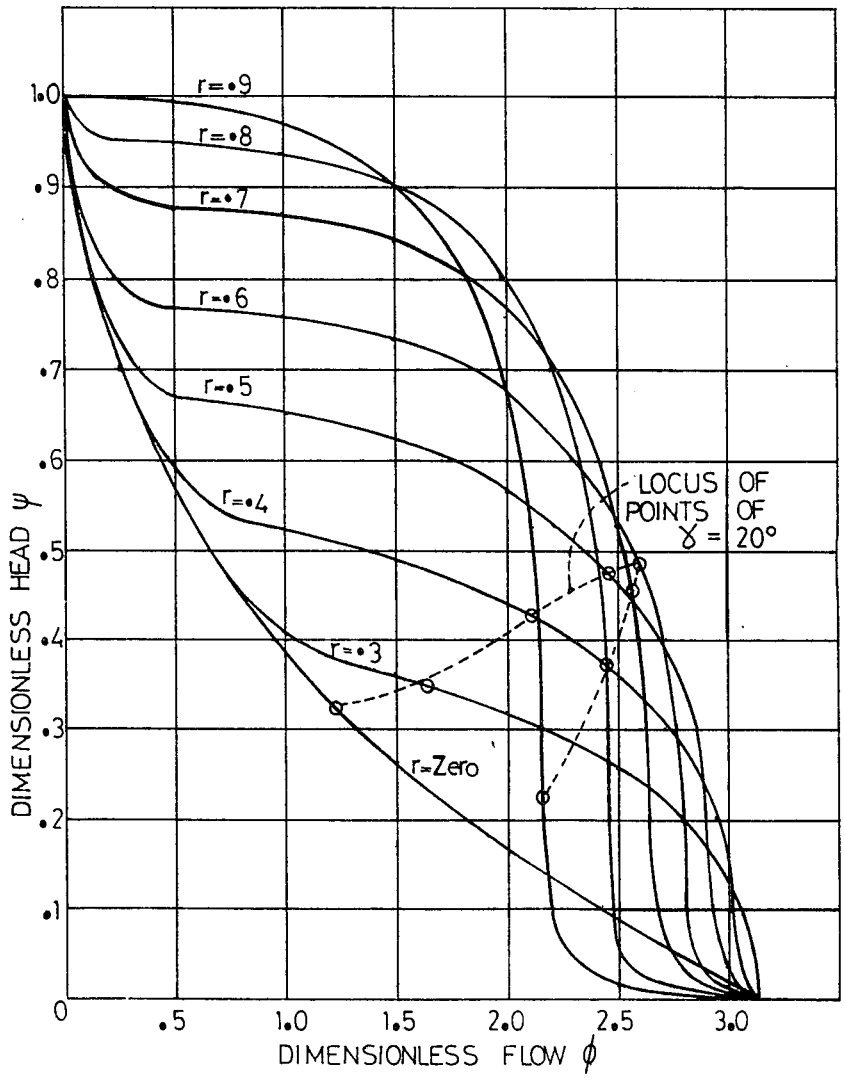
FIG. 8 shows graphically the relationship between certain pump parameters, namely dimensionless flow (abscissa) and dimensionless head (ordinate), for various values of *r* (ratio of actual frequency of pump operation to resonant frequency) for values of *r* below resonance.

The change in flow rate Q with applied head H, can most conveniently be examined with reference to FIG. 8, where dimensionless head $\psi$ is plotted against volumetric efficiency $\phi$ as abscissa for various values of frequency ratio $\rho$.

Dimensionless head $\psi$ is defined as:

$$\psi = \frac{\text{actual head developed across the inlet to outlet of the pump}}{\text{head developed across inlet to outlet under flow shut-off conditions.}} = \frac{H}{H}\,(Q = O)$$

$\psi$ is determined by the mathematical equation:

$\psi = H/Ls\,(g/\Omega^2 R)\,(A/Ap)\,(1 - \rho^2)$

Dimensionless flow (or volumetric efficiency) is defined as:

$$\phi = \frac{\text{the quantity of fluid discharged in a given time}}{\text{the swept volume of the actuators in the same time}}$$

$\phi$ is determined by the mathematical equation:

$\phi = (\pi\, Q/A\, Vp)$

In these expressions the following symbols have the following meanings.

*A* cross-sectional area of induction tube.
*Ap* cross-sectional area of piston (actuator).
*C* capacitance. 1/stiffness = 1/*K*
*H* head across the pump.
*L* fluid inductance *e Ls/A*
*Ls* length of induction tube.
*Q* volumetric discharge rate.
*R* half the stroke of the piston.
*Vp* maximum effective piston velocity in terms of flow rates produced in the induction tube $Vp = \Omega R\,(Ap/A)$.
*g* gravitational acceleration.
$\rho$ frequency ratio $(= \Omega/\Omega o)$.
*t* time.
*V* velocity of flow in induction tube.
$\phi$ dimensionless flow $= \pi Q/A\ Vp$
$\psi$ dimensionless head $= H/Ls\,(g/\Omega^2 R)\,(A/Ap)\,(1 - \rho^2)$
$\Omega$ angular velocity.
$\Omega_o$ angular velocity corresponding to the natural frequency of the resonator $(1\sqrt{/L\ C}) = \sqrt{A\ K/e\ Ls}$
*e* is the specific gravity of the fluid.
$\gamma$ is the angle at which the actuator valve shuts and powered flow starts.

The dimensions of the passageways 62*a*, 62*b*, 65*a*, 65*b* or 162*a*, 162*b*, 165*a*, 165*b* which form the designed fluid inductance means, and the dimensions and elasticity of the components which form the fluid capacitance means are selected having regard to the predetermined speed of operation (or the predetermined speed range) to provide for operation of the pump in accordance with a particular selected characteristic curve which will meet the user's requirement over the working range. Also the selection of fluid inductance and fluid capacitance is made to ensure that under conditions of shut-off at the downstream end of the delivery unit 14 the internal pressure in the pump will not rise above a safe value providing a reasonable margin of safety against damage to components exposed to such pressure.

The characteristics in question are represented in FIG. 8.

The choice of frequency ratio $\rho$ will depend upon particular user requirements. For example, if it is required to maximise the head achievable across the pump before significant flow reversal starts to occur in the inductance, then a value of $\rho$ of between 0.5 and 0.6 would be preferable, giving $\psi = 0.42$ and $\phi = 2.70$ at duty point. In these circumstances the shut-off head would be about 2.0 to 2.5 times the head at duty point. On the other hand the intention might be to restrict the shut-off head to some minimum value and to minimise flow discharge at low head. Under these circumstances, a value of $r$ of 0.2 or 0.3 would be more appropriate.

For a given pump with predetermined design parameters of $\Omega$ (speed of rotation), $A/A_p$ (ratio of cross-sections of induction tube to actuator) 2R (actuator stroke) it is possible using the equation for dimensionless head to calculate the length of inductance $L_s$ required to meet the user's maximum head HQ = 0 or the duty head H. At the same time, using the equation relating inductance and capacitance 1/K to the frequency ratio $\rho$ it is possible to determine the required stiffness K of the capacitive components within the pump.

It will of course be understood that certain of the parameters regarded as predetermined may be varied if desired, in particular R (within limits determined by the driving motor) $\Omega$, and $A/A_p$, the last mentioned, however, preferably being substantially less than unity, e.g. $\frac{1}{8}$ being typical.

Determination of fluid inductance is by way of selection of length and area of the passageways 62*a*, 62*b*, 65*a*, 65*b*, 162*a*, 162*b*, 165*a*, 165*b*. In each case the inductance is given by the expression:

$$\text{Inductance} = e\,L/A$$

where $e$ = is the specific gravity of the fluid to be pumped.

$L$ = is the length of the passageway.

$A$ = is the cross-sectional area of the passageway.

The capacitance of a capacitance component is inversely proportional to its stiffness K and this may be determined by subjecting one face of the capacitance unit to the pressure generated in an incompressible liquid and measuring the displacement (volume) of such liquid at the opposite side of the capacitance component. The gradient presented by the characteristic of pressure (ordinate) plotted against volume (abscissa) represents K (stiffness).

The ability to produce a pump having both the desired working characteristic, and a safe value of pressure at shut-off, is dependent upon the fluid capacitance being operationally effective from the beginning of pressure rise up to shut-off pressure and accordingly it is an essential feature of the present invention and the embodiment of pump now described by way of example, that the components which constitute or give rise to the fluid capacitance shall be exposed (i.e. in pressure communication with) throughout the pumping cycle to the columns of fluid which comprise the fluid inductance. The capacitance may have a linear or approximately linear characteristic relating stiffness to pressure but where the frequency ratio $r$ approaches zero a capacitance having a characteristic in which the pressure (ordinate) and stiffness (abscissa) curve rises with increasing steepness in the region of the upper end of the pressure range would be preferred.

Thus, in the embodiment now described the fluid capacitance components 25*a*, 25*b*, 32*a*, 32*b* will be subject to the pressure of the fluid in and immediately adjacent to the pumping chamber concerned which is dependent upon the fluid inductance presented by the liquid columns already identified. The device shown in FIG. 4 and already mentioned is a further capacitance component.

We claim:

1. A pump comprising a body having at least one pumping chamber communicating at opposite ends respectively with a pump inlet and a pump outlet, an actuator in the pumping chamber reciprocable longitudinally thereof by drive means and having a relatively rigid main central portion and a peripherally extending elastic sealing ring retained in a clearance space and in non-sliding fluid-tight engagement between said central portion and a lateral wall of said pumping chamber, valve means controlling the flow of fluid through said pumping chamber from said inlet to said outlet, and fluid inductance means and fluid capacitance means operative between said pump inlet and outlet for controlling the operational characteristic of the pump, the latter including the improvement wherein:

a. said valve means controlling flow of fluid through said pumping chamber is mounted exclusively on said actuator, b. said body defines a flow path from said inlet to said outlet of a configuration to afford flow in a pressure relief mode internally of said body cyclically from and to said pumping chamber when delivery from said outlet is shut off, c. said fluid capacitance means comprises fluid capacitance means operative throughout the pumping cycle and in continuous communication with said pumping chamber downstream of said actuator.

2. A pump according to claim 1 wherein said fluid inductance comprises a plurality of delivery duct units connected end to end between said outlet of said pumping chamber and said outlet of said pump body, the magnitude of said fluid inductance being dependent upon the length and number of such units present.

3. The combination with a pump as claimed in claim 1 of a stop valve movable between open and closed positions, said stop valve being connected to said pump body downstream of said outlet thereof.

4. A pump according to claim 1 wherein the body has a second pumping chamber also connected with the pump inlet and the pump outlet, the body further includes respective ducts extending from the pumping chambers towards the outlet and said fluid capacitance means includes a structure forming a part of the respective boundary of each of said ducts and said structure being displaceable in a direction from one duct towards the other duct in response to changes in the pressure in one duct relative to the pressure in the other duct.

5. A pump according to claim 1 wherein said fluid capacitance is formed wholly by at least one elastically displaceable or deformable component mounted in the immediate vicinity of said pumping chamber.

6. A pump according to claim 5 wherein said fluid capacitance is provided by one at least of the following components:

a. said peripherally extending elastic sealing ring of said actuator, b. said valve means mounted exclusively on said actuator.

7. A pump according to claim 1 wherein:

a. said pump includes a plurality of said pumping chambers and respectively associated actuators, b. said drive means therefor operate said actuators at uniformly spaced phases throughout the pumping cycle, c. said flow path includes a portion defining a pressure relief flow path including ducts extending respectively from said chambers to said outlet and communicating with each other at a position downstream of each of said chambers.

8. A pump according to claim 7 wherein:

a. said ducts have a common wall separating them from each other and including an aperture adjacent to the ends of said ducts nearer to said pumping chambers, b. said capacitance means comprises i. an element mounted in and closing said aperture, ii. resilient means against which said element is displaceable transversely of said wall in response to difference of fluid pressure in said ducts in the region of said aperture.

9. A pump according to claim 7 wherein:

a. said pump includes at least two axially aligned ones of said pumping chambers, b. said axially aligned pumping chambers are spaced apart axially of each other, c. outer ends of said axially aligned pumping chambers are connected by way of respective manifold passageways defined in said pump body through a delivery duct, d. said delivery duct defines respective outlet passageways separated from each other within said delivery duct by a longitudinally extending internal web and connected respectively to said manifold passageways.

10. A pump according to claim 9 wherein said web terminates at a position spaced upstream from said outlet situated at the downstream end of said delivery duct.

11. The combination of a pump according to claim 10 with a stop valve connected to the downstream end of said delivery duct, said pressure relief portion of said fluid path comprising said passageways on opposite sides of said web and said respective manifold passageways, the former being in communication with each other beyond the downstream end of said web.

* * * * *